United States Patent [19]

de Caussin et al.

[11] 4,155,565

[45] May 22, 1979

[54] ADJUSTABLE SKATEBOARD

[76] Inventors: David M. de Caussin, 17016 Roscoe Blvd., Northridge, Calif. 91325; Scott P. Comstock, 9676 Quartz Ave., Chatsworth, Calif. 91311

[21] Appl. No.: 888,405

[22] Filed: Mar. 20, 1978

[51] Int. Cl.[2] ..... A63C 17/00

[52] U.S. Cl. ..... 280/87.04 A; 280/11.19; 280/11.27; 280/11.28

[58] Field of Search ..... 280/11.28, 11.27, 11.26, 280/11.1 BT, 11.1 R, 11.23, 11.19, 87.04 A, 87.04 R, 87.03, 7.13, 11.25

[56] References Cited

U.S. PATENT DOCUMENTS

| | | | |
|---|---|---|---|
| 131,234 | 9/1872 | Todd | 280/11.19 |
| 332,278 | 12/1885 | Nelson et al. | 280/11.23 |
| 341,999 | 5/1886 | Davis | 280/11.28 |
| 906,281 | 12/1908 | Plimpton | 280/11.19 |
| 4,060,253 | 11/1977 | Oldendorf | 280/87.04 A |

*Primary Examiner*—Joseph F. Peters, Jr.
*Assistant Examiner*—Milton L. Smith
*Attorney, Agent, or Firm*—Singer & Singer

[57] ABSTRACT

A skateboard capable of being adjusted for different weights and different desired ride characteristics without changing the distance between the fore and aft wheels. The truck assembly is mounted on an angled leaf spring and the leaf spring is slideably engaged against a pad having shoulder guides. The pad mounts against the skateboard and the leaf spring is attached to the pad. In one embodiment, the pad contains slots and is movable in a fore and aft direction to change the spring constant of the leaf spring holding the truck. The leaf spring is fixedly positioned to the skateboard and the pad is free to move in a fore and aft direction as a result of the slots thereby allowing the rider to change the effect of the spring and hence the angle to obtain different ride characteristics.

10 Claims, 14 Drawing Figures

Fig. 10.
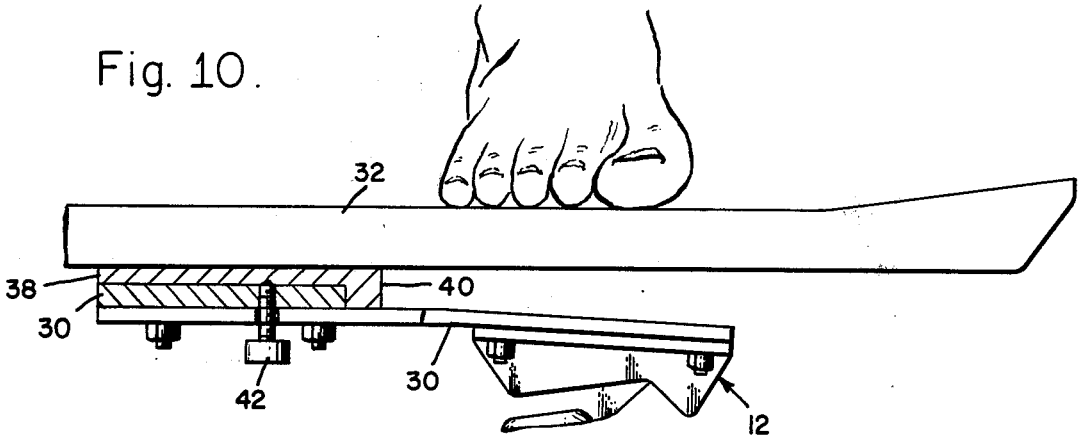
Fig. 11.
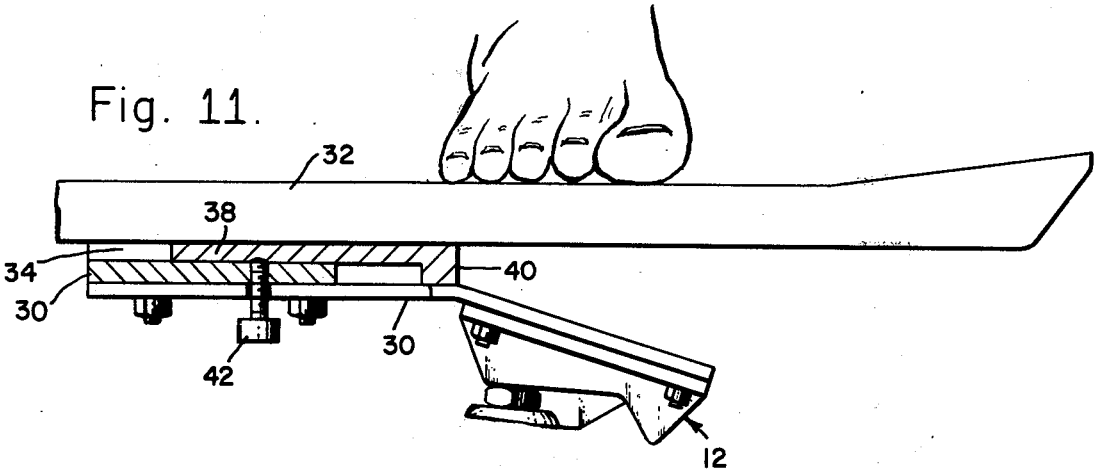
Fig. 8.
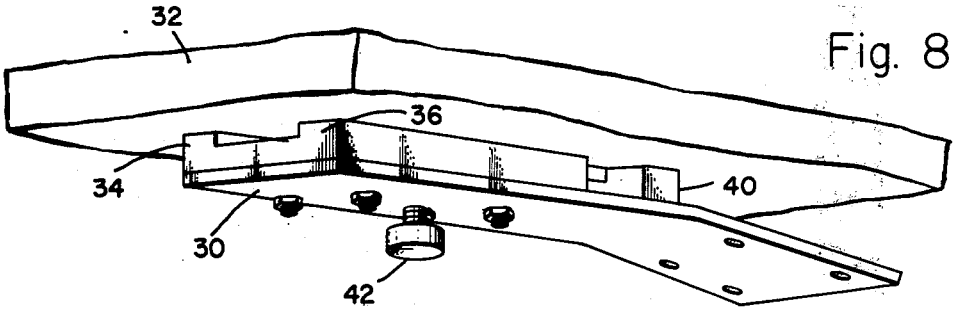
Fig. 14.
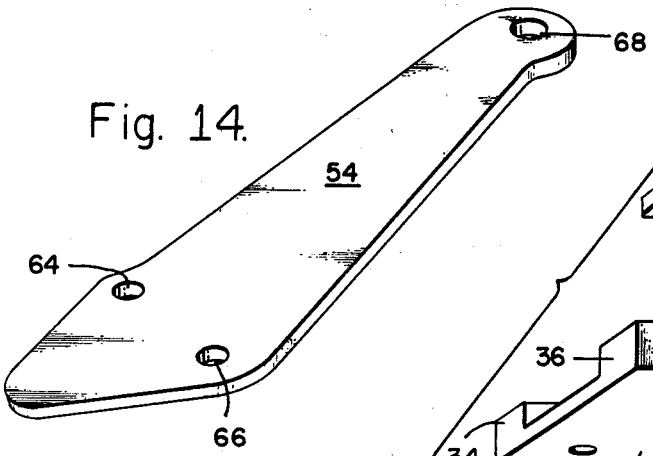
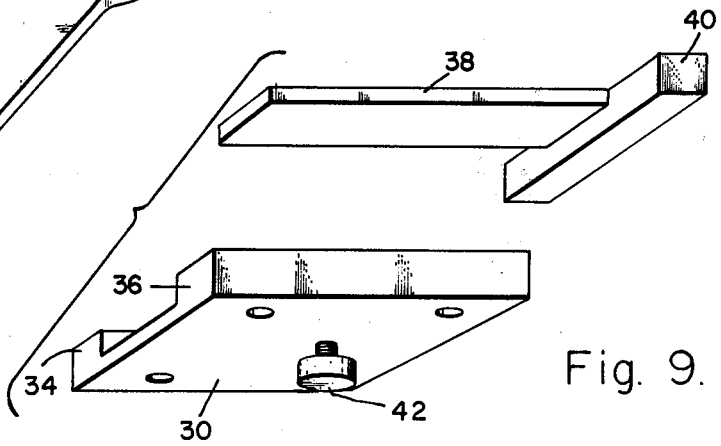
Fig. 9.

ADJUSTABLE SKATEBOARD

This invention relates to a novel skateboard and, more particularly, to an adjustable skateboard that allows an adjustment without changing the distance between the wheels.

The art of designing and riding skateboards has advanced from a simple exercising toy for children to a sophisticated art form practiced by serious athletes in competition with each other. The state-of-the-art has developed to such an extent that it is envisioned that skateboard exercises and competitions will be included in the next Olympics exhibition as a recognized sport.

The riders of skateboards have long felt a need for adjusting or changing the riding characteristics of the trucks upon which the skateboard rides in order to compensate for road conditions, hazards to be expected, and also for the weight of the rider.

The adjustment usually includes changing the spring constant of the spring holding the trucks in order to more accurately control the ride produced by the skateboard and to give the rider a slight edge by way of feel for the events to be performed on the skateboard.

The more advanced skateboard riders have discovered that the angle the truck makes with the skateboard is very important in establishing a turning radius and flexibility of operation of the skateboard.

Unfortunately the prior art does not disclose convenient means for adjusting the skateboards other than to simply elongate the distance between the wheels in an effort to change the ride and compensate for the different weights of riders.

These prior art adjustments are unsatisfactory because changing the distance between the front and rear wheels of the skateboard seriously alters the ride characteristic of the skateboard, causing the rider more problems in adjusting to this new dimension than the benefits to be achieved by finely tuning the skateboard for a new ride characteristic.

It was necessary therefore to completely disassemble and reassemble the skateboard with different springs and wedged inserts, which practice was time-consuming and impossible to achieve in the field. This of course led to the practice of the rider having a plurality of skateboards which unfortunately became expensive when it is considered that a finely tuned skateboard may vary in price from $60.00 to $150.00.

The problem solved by the present invention is an adjustable skateboard that does not change the distance between the fore and aft wheels and at the same time allows the rider to change the riding characteristics by changing the spring constant and angle of the leaf spring holding the trucks which contain the wheels.

In this invention there is disclosed a resilient skateboard having spaced-apart mounting holes and a pair of trucks each having two wheels mounted on a steerable axle. The steerable axle is heavily damped according to the needs of the rider and may vary from very soft to very firm resiliency, depending only on the skill of the rider and his desires.

A pair of angled leaf springs each having corresponding mounting holes at one end are fixedly attached at the other end to one of the trucks. The angle on the leaf spring is usually not greater than twenty degrees. A pair of rectangular slide pads each having a pair of channels on one side for slideably engaging said leaf spring and a flat reverse side for slideably contacting said board is interposed between the leaf spring and the bottom of the skateboard.

In one embodiment the slide pads have slotted openings corresponding to the mounting holes in the skateboard and the leaf spring. A plurality of mounting screws keeps the assembly comprising the spring and the slide pads in a fixed relationship with the skateboard.

The spring assembly is fixedly attached to the skateboard and is cantilevered from the slide pad to provide the springing action desired by the rider. The adjustment is achieved by loosening the mounting screws and moving the slide pads from one extreme of the slotted holes to the other, thereby increasing or decreasing the length of the trucks on the cantilevered spring support. This action increases or decreases the springing action of the cantilevered spring determined only by the position of the pads.

Since the pads are moved and not the spring, the distance between the fore and aft wheels remains constant while at the same time allowing the rider a complete range of springing action from very soft to very strong determined only by the position of the pads ultimately selected.

In the broad concept the invention makes use of a single leaf spring having a bend not exceeding twenty degrees, having the truck mounted on one end. The other end is mounted to the skateboard against the pad and in which the pad is moved in a fore and aft direction, thereby changing the fulcrum position of the leaf spring.

Changing the fulcrum position changes the spring constant of the cantilevered spring and also changes the effective angle of the leaf spring with respect to the skateboard under a given load condition.

In this manner it is possible for a rider having a given weight to obtain a variable range of spring constants and a variable range of truck angles depending only upon his desires and his skill in manipulating the skateboard.

Further objects and advantages of the present invention will be made more apparent by referring now to the accompanying drawings wherein:

FIG. 8 illustrates a second embodiment for changing the fulcrum angle of the leaf spring;

FIG. 9 illustrates an exploded view of the assembly illustrated in FIG. 8;

FIG. 10 illustrates a first position for the assembly illustrated in FIG. 8;

FIG. 11 illustrates a second position for the assembly illustrated in FIG. 8;

FIG. 14 illustrates a guide bar for use with the front and rear truck assemblies for use with all of the embodiments illustrated herein.

Figure 1:
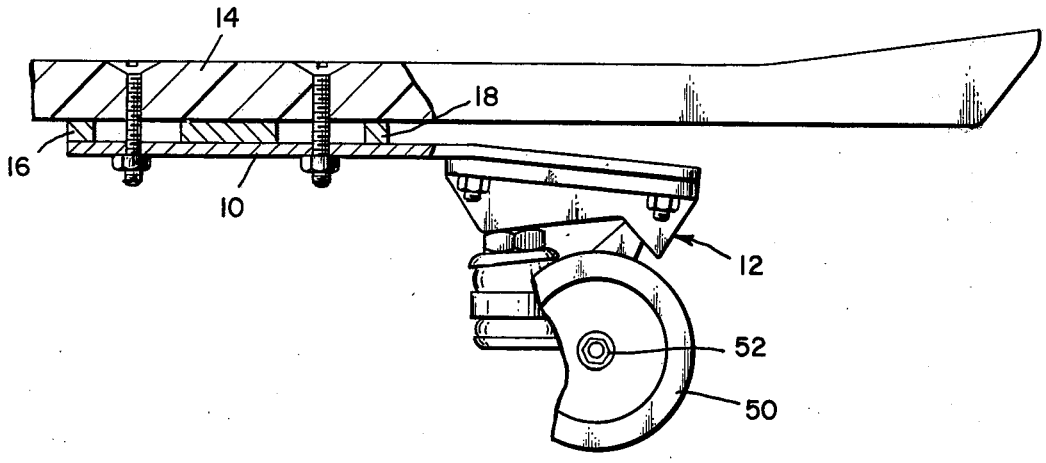
FIG. 1 illustrates a truck assembly connected to a leaf spring having an angle not exceeding twenty degrees.

Referring now to FIG. 1, there is shown a cantilevered spring 10 having an angle portion not exceeding twenty degrees. A truck assembly 12 containing a pair of wheels is fixedly connected to the angled portion of the leaf spring 10.

In the practice of the present invention the commonality to all of the embodiments is the combination of the angled leaf spring 10 and the truck assembly 12. The leaf spring 10 is fixedly attached to a skateboard 14 through an intervening pad member 16. In all of the embodiments the pad member 16 is caused to move in a fore and aft direction thereby changing the fulcrum point 18 of the leaf spring 10.

By moving the pad 16 in a fore and aft direction and leaving the leaf spring 10 fixed in its relationship to the skateboard 14, the operator and user of the skateboard can obtain a wide range of spring constants and effective angles with respect to the skateboard and without changing the physical distance between the wheels of the skateboard. It is possible therefore for the user to independently tune the fore and aft truck wheels of his skateboard without changing the distance between the wheels and without otherwise changing the riding constants of his finely tuned skateboard.

Figure 2:
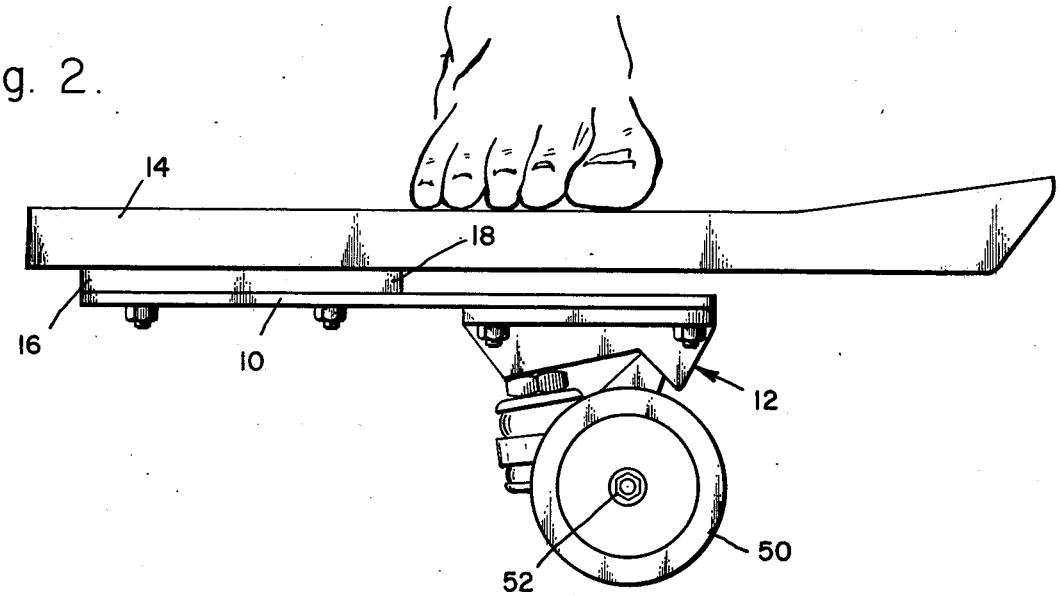
FIG. 2 illustrates a first position in varying the fulcrum angle.
Figure 3:
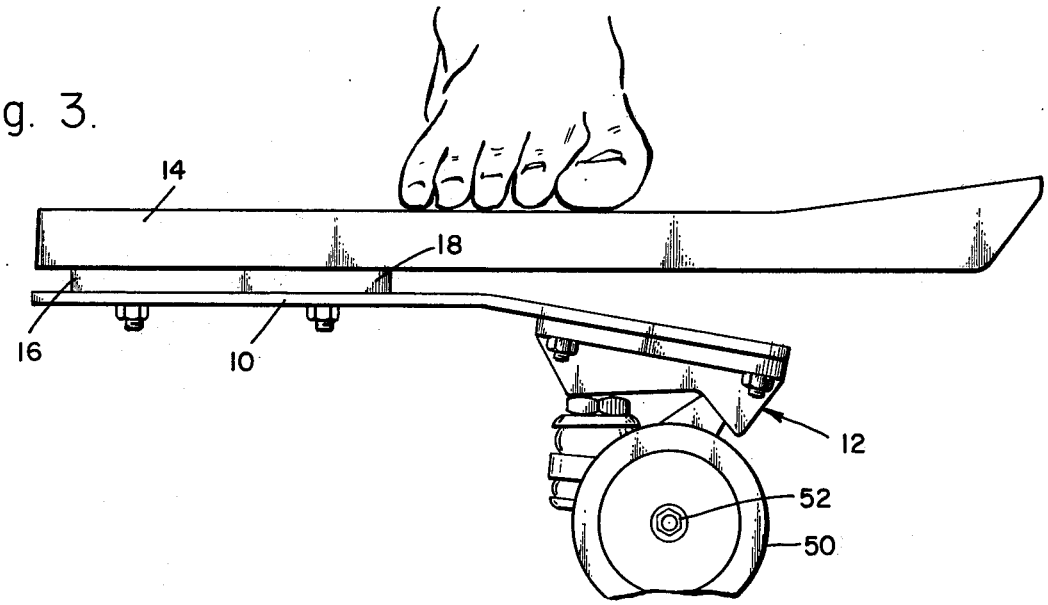
FIG. 3 illustrates a second position in varying the fulcrum angle.
Figure 4:
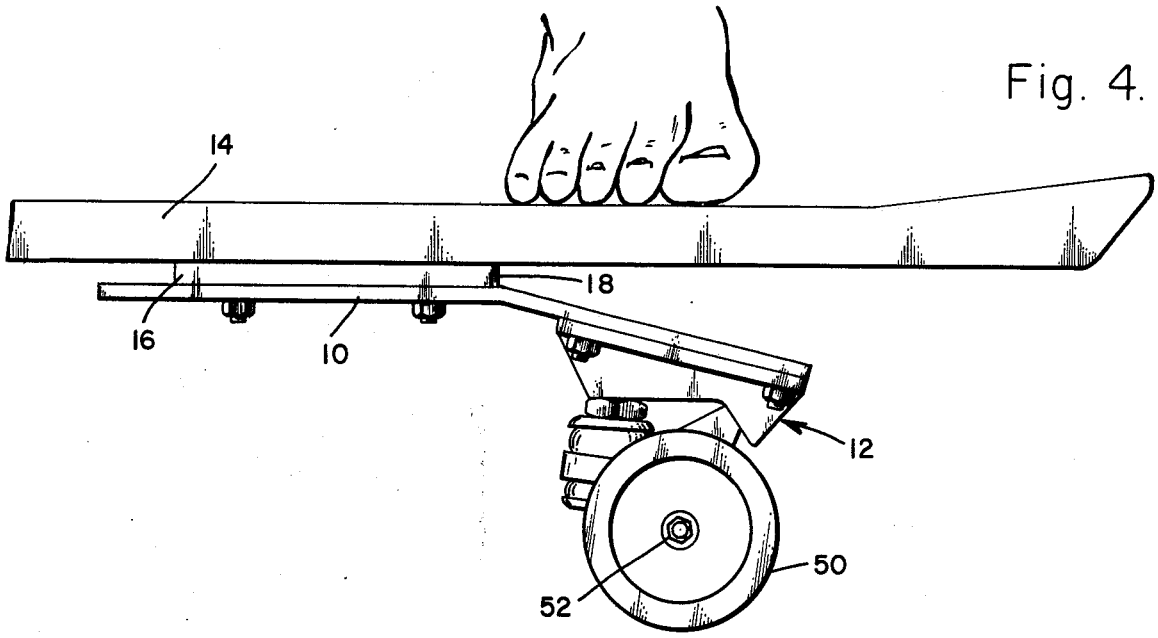
FIG. 4 illustrates a third position in varying the fulcrum angle.

Referring now to FIGS. 2, 3, and 4, there is shown a skateboard 14 constructed according to the teachings of this invention and in which the movable pad 16 is located in different positions to thereby illustrate the varying angle of the truck assembly 12 with respect to the skateboard as the spring constant of the leaf spring 10 is varied under load conditions.

Referring now to FIG. 2, there is shown pad 16 located in the most rearward position with the fulcrum point 18 exposing a maximum length of spring of leaf spring 10 supporting the truck assembly 12.

In this condition leaf spring 10 has the weakest spring constant and under a given load condition the angle of the spring 10 will be at a minimum with respect to the skateboard 14 under the load as illustrated.

Referring now to FIG. 3, there is illustrated pad 16 moved to an intermediate position thereby exposing less of the spring 10 supporting the truck assembly 12. Under the same load condition the angle of the leaf spring 10 is at some intermediate position between its maximum angle of twenty degrees and the minimum angle as illustrated in FIG. 2. The exact angle will be a function of the leaf spring 10 and the weight of the rider standing on the skateboard 14. It will be appreciated, however, that in varying the pad 16 the leaf spring 10 remains fixed and does not move.

Referring now to FIG. 4, there is shown pad 16 moved to the extreme front position thereby exposing a minimum of the leaf spring 10 supporting the truck assembly 12. In this position the truck assembly will maintain a maximum angle under a given load condition since the spring constant of the unsupported cantilevered portion of the leaf spring 10 is at a maximum.

A review of FIGS. 2, 3 and 4 will show that for a given leaf spring 10, that moving the pad 16 from the rearward position to the front position provides a varying spring constant for the unsupported leaf spring supporting the truck assembly 12, thereby giving the rider a control in adjusting the angle of the truck assembly with respect to the skateboard 14.

Figure 5:
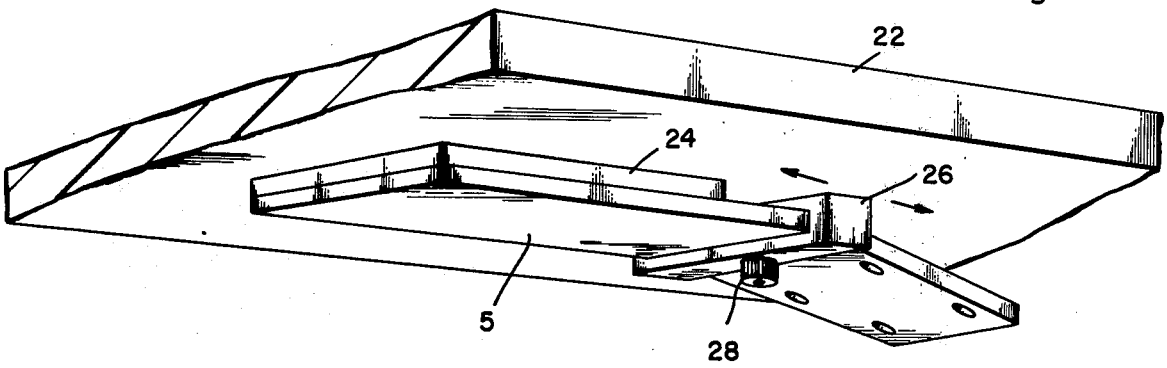
FIG. 5 illustrates a first embodiment for varying the fulcrum angle of the leaf spring.

Referring now to FIG. 5, there is illustrated a first embodiment of the invention showing a leaf spring 20 having an angle not exceeding twenty degrees fixedly attached to a skatebord 22 through a fixed pad 24.

The fixed pad 24 is located in the most rearward position under the leaf spring 20 thereby exposing the maximum length of unsupported leaf spring.

Located about the leaf spring 20 is a sliding ring 26 adapted to completely encircle the leaf spring 20 and which includes a locking screw 28 adapted to project through the sliding ring and against the leaf spring.

Figure 6:
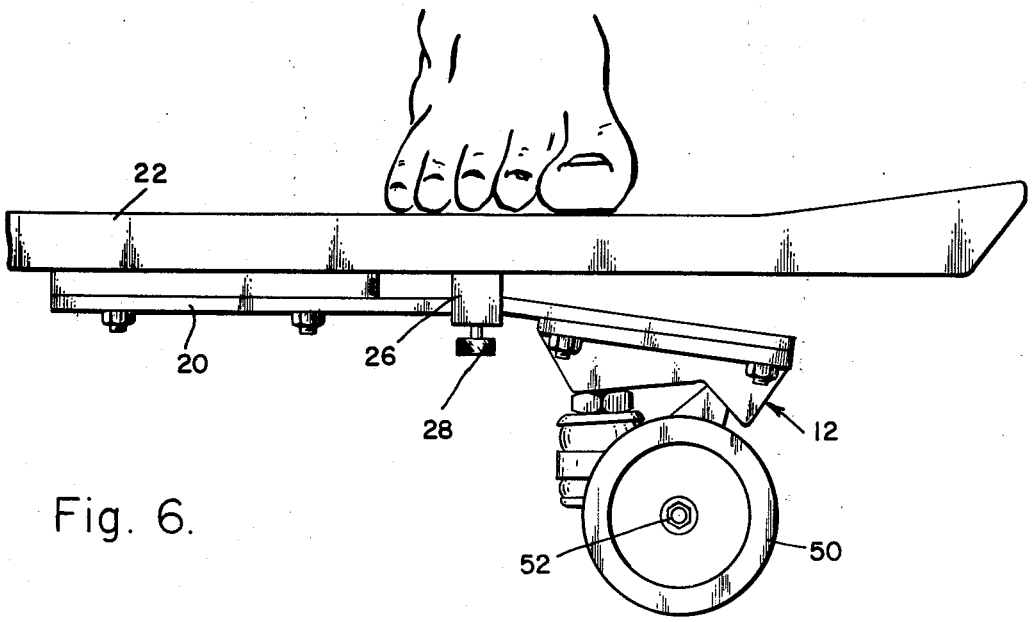
FIG. 6 illustrates a first position of the assembly shown in FIG. 5.

Referring now to FIG. 6, there is shown the assembly illustrated in FIG. 5 used to obtain a varying fulcrum position for the leaf spring 20. The skateboard 22 contains the leaf spring 20 fixedly positioned with the pad 24 and in which the angled portion of the leaf spring contains the truck assembly 12. Located between the truck assembly 12 and the pad 24 is the sliding ring 26 adapted to move in a fore and aft direction around the leaf spring 20. FIG. 6 illustrates the sliding ring in the most rearward position thereby exposing the smallest length of unsupported leaf spring 20 supporting the truck assembly 12. In this position the spring constant is the greatest and for a given weight condition the angle of the leaf spring 20 will be at a maximum angle.

Figure 7:
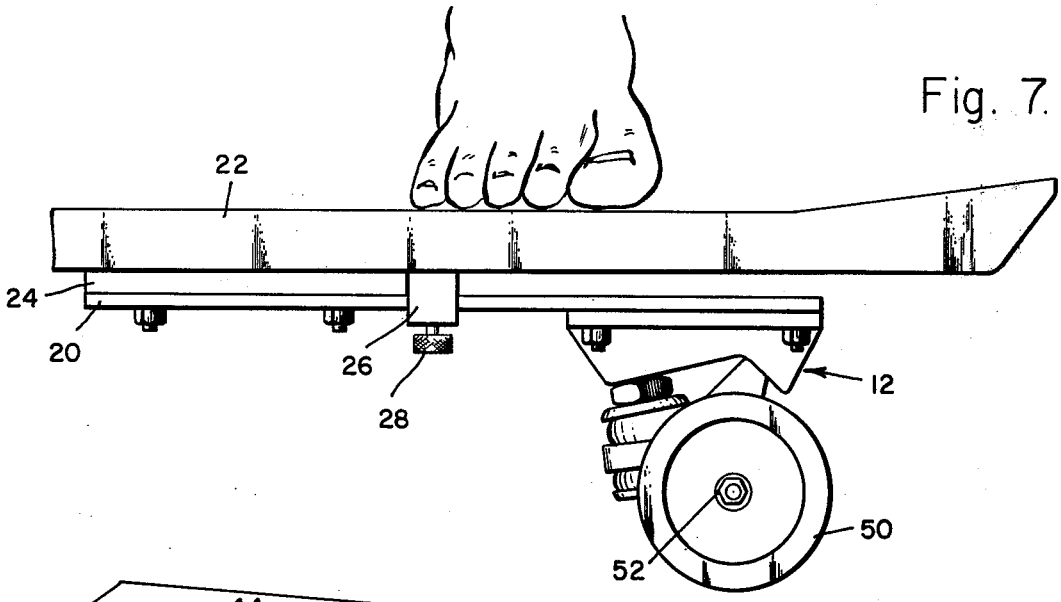
FIG. 7 illustrates a second position of the assembly illustrated in FIG. 5.

Referring now to FIG. 7, there is illustrated a second position with the sliding ring 26 moved to the forward position thereby exposing a maximum length of unsupported leaf spring 20 supporting truck assembly 12. In this position the spring constant will be at a minimum and for a given weight condition the angle of the leaf spring 20 with respect to the skateboard 22 will be at a minimum.

In both FIGS. 6 and 7, the sliding ring 26 is moved by first loosening the locking screw 28 and locating a position while the board is unloaded and then by trial and error selecting a position of the locking ring 26 that provides the rider with the degree of flexibility and control of the skateboard consistent with his ability. The locking screw 28 will maintain that position until the user elects to vary the fulcrum position for a different ride condition.

Referring now to FIG. 8, there is shown a second embodiment for illustrating the fulcrum position of the leaf spring and without moving the leaf spring from its fixed position with respect to the skateboard.

Referring now to FIG. 8, there is shown a leaf spring 30 fixedly attached to a skateboard 32 through an intervening pad assembly 34. The leaf spring 30 has a bend not exceeding twenty degrees and in which a truck assembly is adapted to be located on the angled portion of the spring. The pad assembly 34 is located under the straight portion of the leaf spring 30 so as to expose a maximum length of the leaf spring holding the truck assembly.

The pad assembly 34 contains a channel 36 for accepting a T bar member 38 that is adapted to slide within the channel 36 of pad 34 and in a fore and aft direction. Located on the bar member 38 is a T member 40 having a width equal to the width of the leaf spring 30. The T member 40 moves in a fore and aft direction and provides the means for changing the fulcrum length of the unsupported leaf spring 30 holding the truck assembly. Centrally located on the flat portion of the leaf spring 30 is a locking screw 42 adapted to penetrate through the leaf spring and through the pad assembly 34 so as to contact bar 38 and thereby lock the T member 40 in a preferred position.

Referring now to FIG. 9, there is shown an exploded view of the pad assembly 34 and the bar 38 and T member 40. The width of the bar 38 is equal to the width of the channel 36 thereby ensuring that bar 38 and T membeer 40 will be supported when moved and locked in a fore and aft position.

Referring now to FIG. 10, there is shown a first position for the adjustment of the assembly illustrated in FIG. 8. With the locking screw 42 loosened, the T member 40 and the bar 38 are moved in the rearward direction and locked in position thereby exposing a maximum length of leaf spring 30 supporting the truck assembly 12. In this position the spring constant is at a minimum and the angle of the leaf spring 30 with respect to skateboard 32 will be at a minimum.

Referring now to FIG. 11, there is shown the position of the T member 40 located in the forward position thereby providing a minimum length of leaf spring 30 supporting truck assembly 12. In this position the spring constant of the leaf spring 30 is at a maximum and the angle will be at a maximum.

Figure 12:
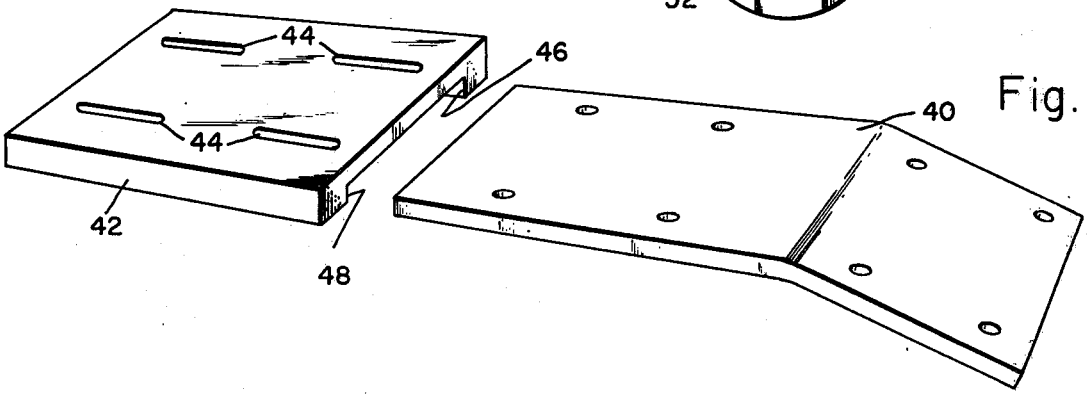
FIG. 12 illustrates a third embodiment for varying the fulcrum position of the leaf spring.

Referring now to FIG. 12, there is shown a third embodiment for varying the spring constant of the cantilevered leaf spring.

In this embodiment the leaf spring 40 is constructed as before and that is with an angle not exceeding twenty degrees and in which the angled portion is adapted to support the truck assembly. The leaf spring 40 is fixedly attached to a skateboard through a pad assembly 42 having elongated holes 44 corresponding to the mounting holes located on the leaf spring 40.

The pad assembly 42 contains guide rails 46 and 48, respectively, which form a channel for accepting the width of the leaf spring 40. In this fashion the pad assembly 42 is adapted to move in a fore and aft direction around the leaf spring 40.

Figure 13:
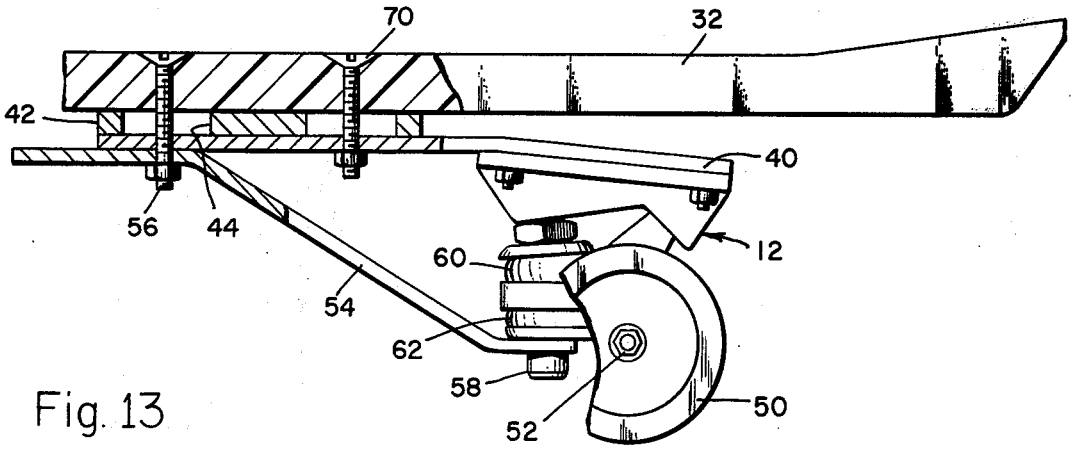
FIG. 13 illustrates a first position for the assembly illustrated in FIG. 12.

Referring now to FIG. 13, there is shown a cross-section of the truck 12, spring 40 and pad 42 as connected to the skateboard 32.

The truck 12 is shown as comprising a pair of wheels 50 connected to a common steerable axle 52 which can be steered depending upon the agility of the rider and the weight of the rider. A jump bar 54 is shown connected between the mounting screws 56 holding the spring 40 and pad 42 to the skateboard 32 and nut 58 that holds the stack-up comprising the resilient members 60 and 62 on the truck 12.

The jump bar 54 is a tapered metal bar having suitable openings at each end and provides a means to the user of negotiating obstacles when moving in either a fore or aft direction. The jump bar is more fully illustrated in connection with FIG. 14 which illustrates a pair of openings 64 and 66 at one end corresponding to the mounting holes on the skateboard 32 for securing the spring and pad together. A pair of screws 56 as illustrated in FIG. 13 are inserted through holes 64 and 66 to provide the mounting and securing of the jump bar 54. A single hole 68 located at the other end of the jump bar is adapted to be secured by nut 58 on the truck assembly 12 as illustrated in FIG. 13.

It will be appreciated that a single size jump bar 54 will accommodate all spring adjustments desired by the user and regardless of which embodiment adjustment is used. This is accomplished because the fixed dimension between the support and the wheel is not changed when the spring adjustment is changed in accordance with this invention. Varying spring adjustments are achieved by moving the fulcrum point or pad assembly and do not entail moving the spring. In this way the fixed dimension between the truck and the skateboard is always maintained and the physical dimension between opposing truck assemblies is always fixed regardless of the adjustment desired by the rider.

It will be appreciated therefore that once the jump bar is installed it need never be changed for different spring adjustments desired or required by the user. In addition the jump bar may be secured on either both trucks or only a single truck depending only on the needs of the user.

Referring again to FIG. 13, there is shown pad assembly 42 located in an intermediate position and in which the elongated holes 44 are centrally positioned with respect to the front mounting screws 56 and the rear mounting screw 70.

In all embodiments the spring 40 is fixed and only the pad assembly 42 is varied to thereby change the fulcrum position for the unsupported length of the spring holding the truck assembly.

In practicing the invention all three embodiments have been used and evaluated and it is the consensus that the preferred embodiment is the adjustable ring illustrated in FIGS. 5, 6 and 7. Since the ring 26 is not a bearing member, it may be easily moved by loosening the lock nut 28 without additional tools and in a simple and direct manner.

We claim:

1. An adjustable skateboard comprising:

a resilient board, a pair of trucks each having two wheels mounted on a steerable axle, a pair of leaf springs each having an angle and being fixedly attached at one end to one of said trucks, and a pair of movable spring support members each interposed between one of said leaf springs and said board and movable in a fore and aft direction for independently changing the fulcrum position of each spring without moving said spring.

2. An adjustable skateboard according to claim 1 in which each movable spring support member consists of a rectangular pad having a pair of spaced-apart guide rails on one side forming a channel for engaging said leaf spring and a flat reverse side for contacting said board whereby moving said pad moves the fulcrum position of each spring.

3. An adjustable skateboard according to claim 2 in which each of said pads includes a plurality of slotted mounting holes whereby said pads can be moved without moving said springs.

4. An adjustable skateboard according to claim 2 in which the distance between said spaced-apart guide rails is equal to the width of said leaf spring thereby providing directional control for each of said leaf springs over the full range of fore and aft movements of said pads.

5. An adjustable skateboard according to claim 1 in which each of said leaf springs is bent at an angle not to exceed twenty degrees thereby providing additional clearance between the board and the spring.

6. An adjustable skateboard according to claim 1 in which each movable spring support member consists of a fixed spacer located between said spring and said board, said spacer having a channel on one side adjacent said board and a flat reverse side adjacent said spring, and a slideable T shaped member having a longitudinal portion and a transverse portion, said longitudinal portion movable within said channel on said spacer and said transverse portion interposed between said spring and said board whereby independently moving said T shaped member changes the fulcrum position of the spring.

7. An adjustable skateboard according to claim 6 which includes a locking screw located in said spring and extending to said T shaped member whereby moving said locking screw maintains the relative position between said T shaped member and said spring.

8. An adjustable skateboard according to claim 1 in which each of said spring support members includes a movable ring shaped member encircling said spring and providing a movable fulcrum support between said spring and said board.

9. An adjustable skateboard comprising:

a resilient board having spaced-apart mounting holes, a pair of trucks each having two wheels mounted on a steerable axle, a pair of leaf springs each having corresponding mounting holes at one end and being fixedly attached at the other end to one of said trucks, a pair of rectangular pads each interposed between one of said leaf springs and said board, a plurality of mounting screws for holding each combination of leaf spring and pad to said board, and a movable ring assembly completely encompassing each of said leaf springs and located between said truck assembly and said pad assembly for changing the fulcrum position of the leaf spring supporting said truck assembly.

10. An adjustable skateboard according to claim 6 which includes a locking screw located in said ring assembly and adapted to contact said leaf spring whereby the relative position of said ring assembly and said leaf spring can be movably fixed without disassembly of the leaf spring from the skateboard.

* * * * *